US005502346A

United States Patent [19]

Hsieh

[11] Patent Number: 5,502,346

[45] Date of Patent: Mar. 26, 1996

[54] APPARATUS TO GENERATE CORONA DISCHARGES

[75] Inventor: Ting-Shin Hsieh, Taipei, Taiwan

[73] Assignee: Xetin Co., Ltd., Taipei, Taiwan

[21] Appl. No.: 287,747

[22] Filed: Aug. 9, 1994

[51] Int. Cl.[6] ..... H01J 1/88; H01T 19/00

[52] U.S. Cl. ..... 313/247; 313/244; 313/246; 313/39; 313/622; 313/632; 313/231.71; 361/227; 361/230

[58] Field of Search ..... 313/30, 39, 238, 313/244, 246, 247, 256, 318.02, 611, 612, 622, 624, 631, 632, 231.01, 231.71; 361/120, 230, 225, 227

[56] References Cited

U.S. PATENT DOCUMENTS 4,109,289 8/1978 Kuge et al. ..... 361/230

4,920,266 4/1990 Reale ..... 361/230

*Primary Examiner*—Nimeshkumar D. Patel

*Attorney, Agent, or Firm*—Pro-Techtor International

[57] ABSTRACT

An apparatus to generate corona discharges that consists of (a) a ground electrode tube, (b) a single-opening insulating tube inserted into the ground electrode tube, (c) a high-voltage electrode tube inserted into the insulating tube, and (d) two insulating caps. An air gap is formed between the ground electrode tube and the insulating tube. The high-voltage tube is inserted in the center of the assembly, which is held in position by the insulating caps.

8 Claims, 4 Drawing Sheets

APPARATUS TO GENERATE CORONA DISCHARGES

(A) BACKGROUND OF THE INVENTION

1. Field of the Invention

The present invention relates to an improvement in the configuration of corona dischargers employed in air-purifying devices as a result of which the discharger can generate coronas more effectively and which makes it more easy to assemble than conventional corona dischargers.

2. Description of the Prior Art

Figure 1:
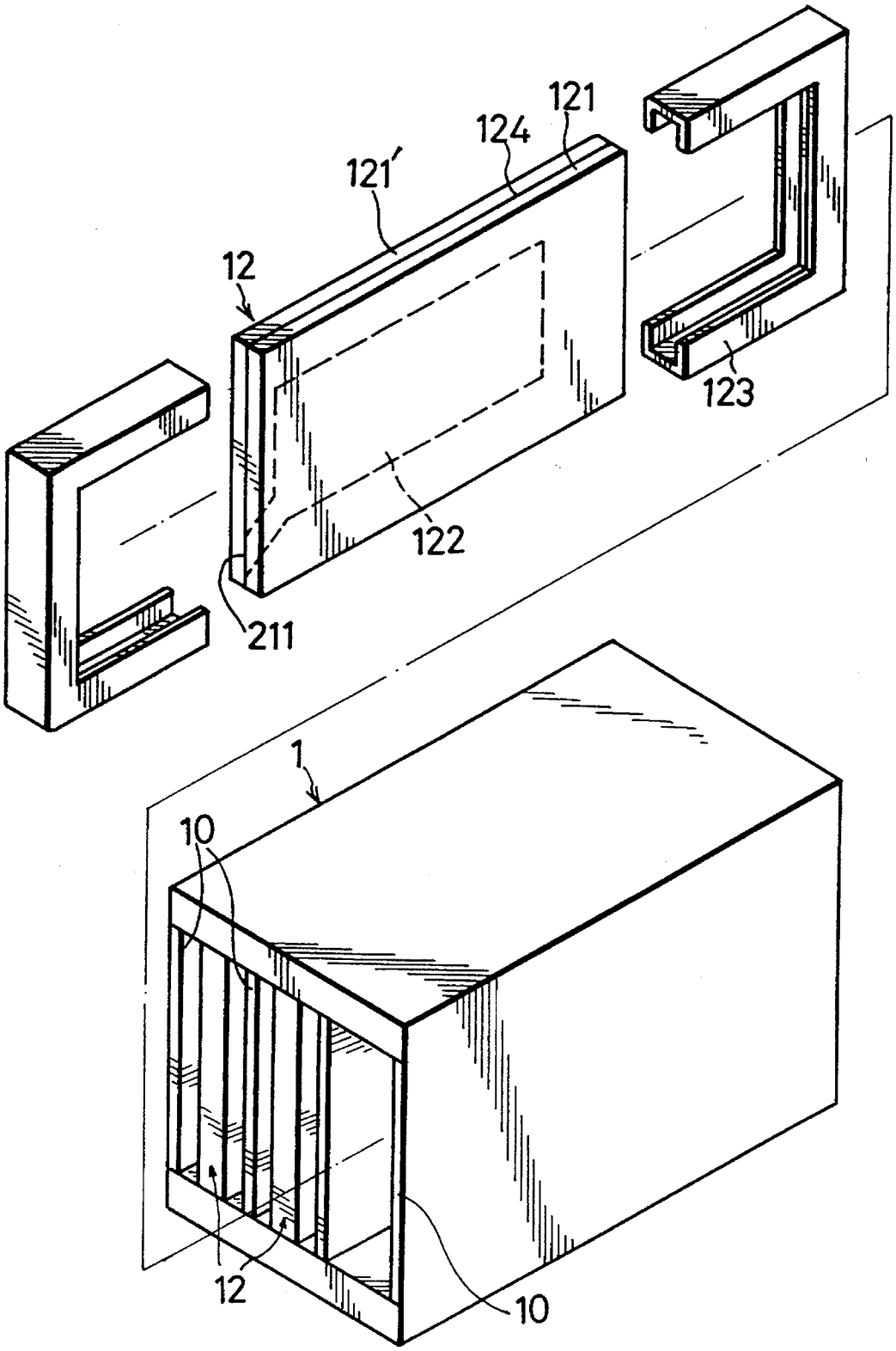
FIG.1 PRIOR ART

The term "corona discharge" refers to the surface discharge phenomenon between a high-voltage electrode and a low-voltage electrode which can be used to ionize air or gases passing between these two electrodes. In practical applications, corona discharges can be employed to purify air and generate ozone. Proper insulation of the high-voltage and low-voltage electrodes is the most important consideration in the configuration of corona dischargers. If the insulation is improper, the discharge of electricity can become localized, resulting in failure to produce a corona. Today's corona dischargers employed in air-purifying devices typically use a configuration such as that disclosed in the Republic of China Patent No. 78212629. Specifically, as shown in FIG. 1, the device consists of a ground casing 1 equipped with one or more slots separated by ground plates 10, with the high-voltage plates 12 inserted into these slots, thereby forming a system in which the ground plate 10 and high-voltage plate 12 are arranged in an alternate order. The high-voltage plate 12 consists of a pair of insulating plates 121 and 121' which sandwich an electrode piece 122. The gap 124 formed between the insulating plates 121 and 121' is sealed with an insulating adhesive material. In order to prevent the formation of cracks due to aging of the insulating adhesive material after the device has been in use for a period of time, an insulating cap assembly 123 is inserted along the gap 124, which complicates the assembly operation. Casing 1 has an open-end configuration allowing air to be forced through the spacing between the high-voltage plate 12 and ground plate 10. Slight noises generated by the electrical discharge are amplified by this configuration. Furthermore, heat is generated during the electrical discharge, causing the electrode plates to heat up. For example, the surface of the ground electrode plate (or rod) of conventional air conditioning-type corona dischargers reaches temperatures as high as 80° C. after continuous use over an extended period of time; consequently, these conventional corona dischargers typically cannot he used continuously for more than 24 hours if damage is to be avoided.

(B) SUMMARY OF THE INVENTION

In light of the aforementioned problems and the desire of the inventor to offer a better product to consumers, the inventor arrived at the present invention after discovering a novel air conditioning-type corona discharger. Specifically, the present invention relates to a corona discharger in which the surface of the high-voltage electrode tube is plated with 24K gold to increase the conductivity.

The other characteristic of the present invention is that the surface of the high-voltage electrode robe is coated with a heat-resistant shrink film, so that the high-voltage electrode tube, when inserted into a single-opening insulating tube, can adhere tightly to its inner wall to protect the surface of the high-voltage electrode tube from being damaged by corona discharges.

Another characteristic of the present invention is that the high-voltage electrode tube has a smaller cross-sectional area and a larger resistance than a solid high-voltage electrode rod of the same diameter, thereby reducing the amount of heat generated during operation.

Another characteristic of the present invention is that upon inserting the high-voltage electrode tube and single-opening insulating tube into a ground electrode tube,-the two ends are each closed with a cap, the function of the cap being to direct the air flow and to dampen the noises generated during the corona discharge.

(C) BRIEF DESCRIPTION OF THE DRAWINGS

A preferred practical example, including figures, is described below to explain the technical features of the present invention.

FIG. 1: A cut-away view of the corona discharger disclosed in the Republic of China Patent No. 78212629.

Figure 2:
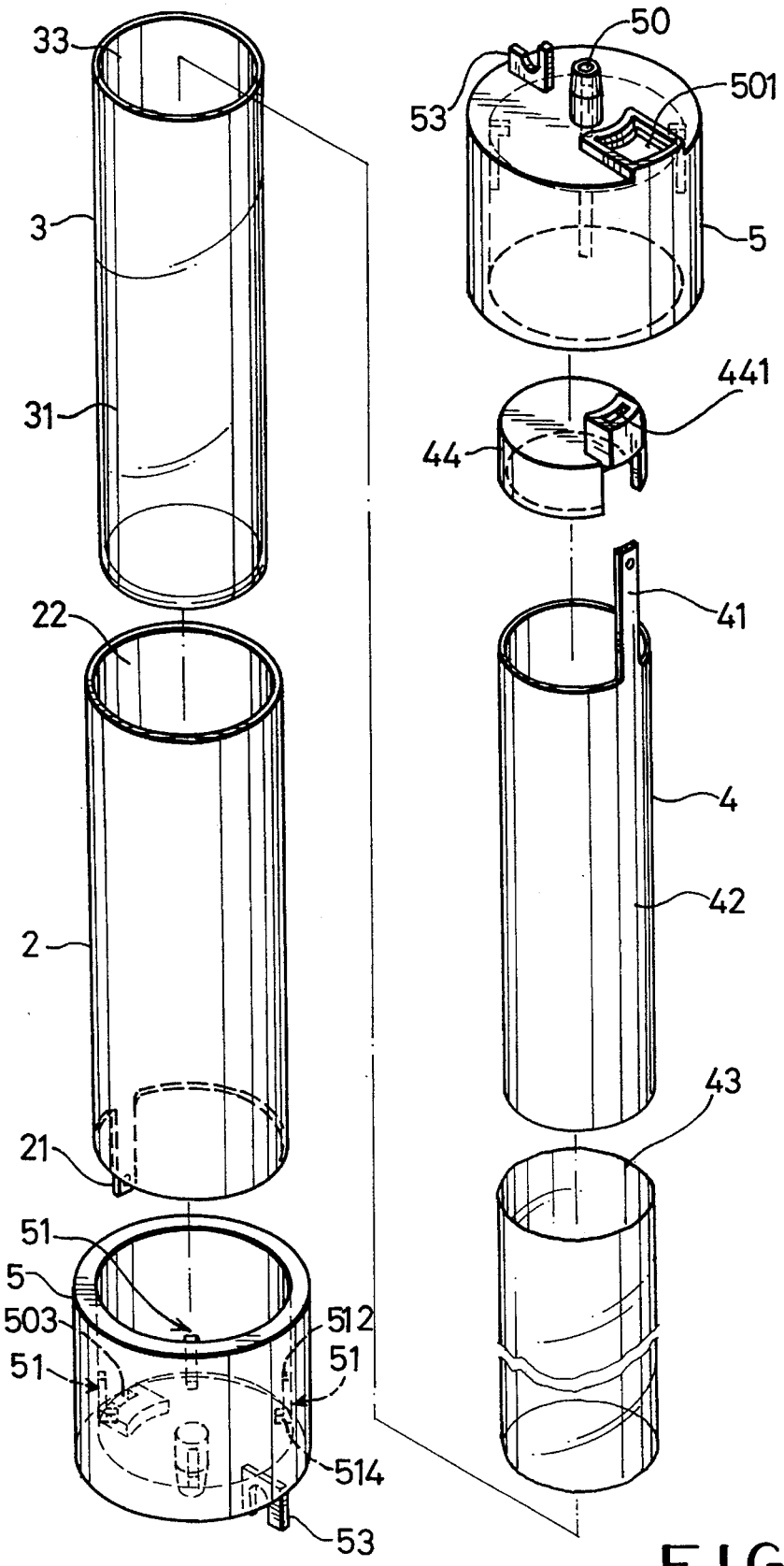

FIG. 2: A cut-away view of the corona discharger according to the present invention.

Figure 3:
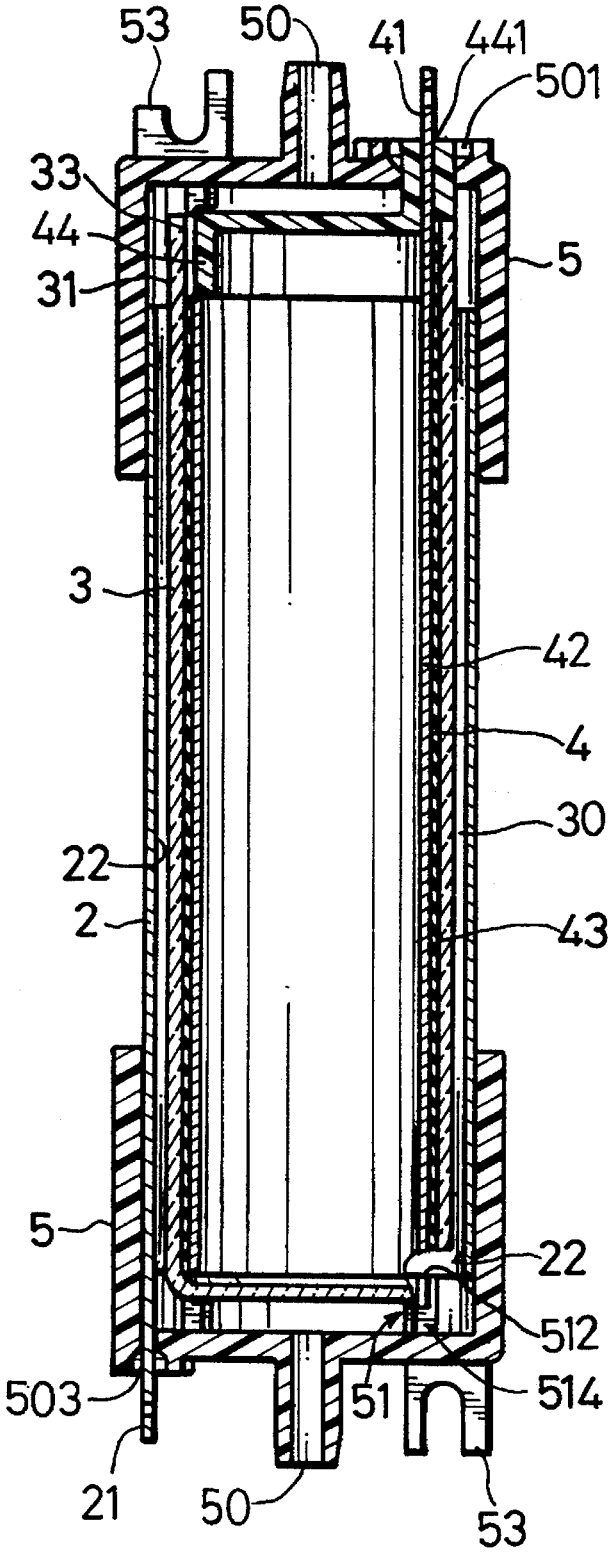

FIG. 3: A cross-sectional view of the assembled corona discharger of the present invention.

Figure 4:
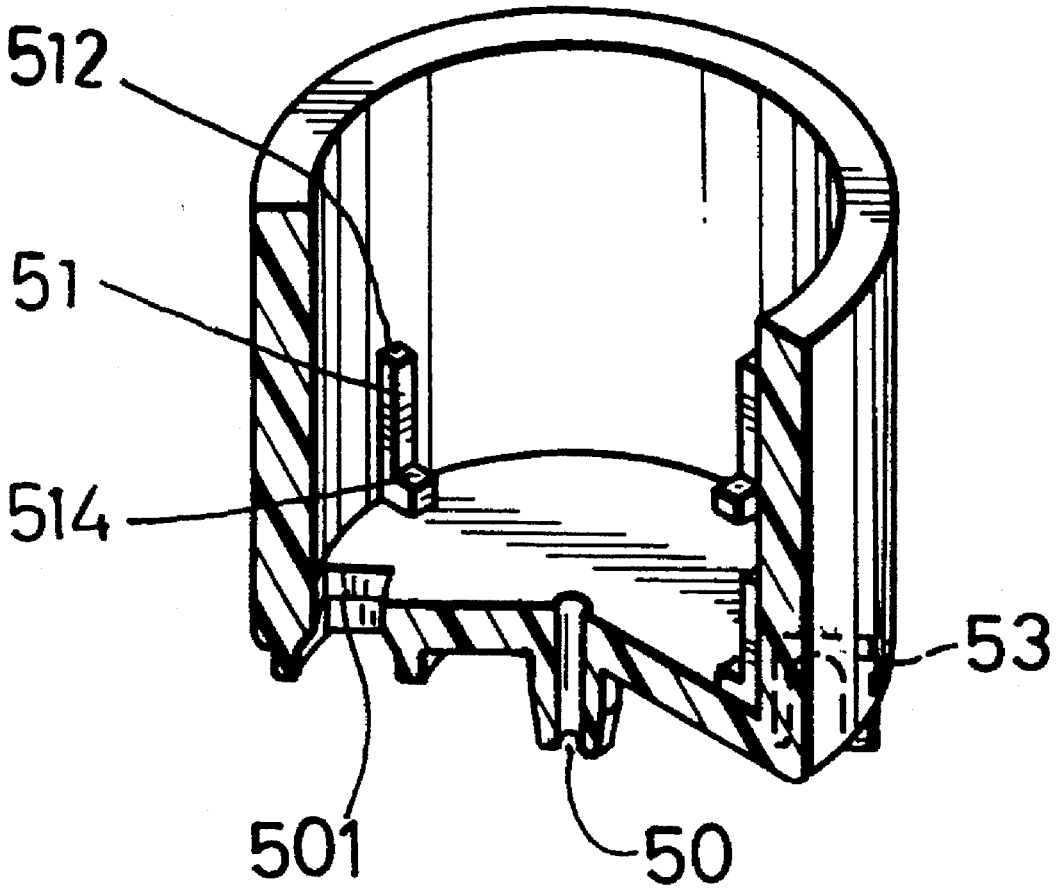

FIG. 4: A cut-away view of the cap of the present invention.

(D) DESCRIPTION OF THE PREFERRED EMBODIMENT

As shown in FIGS. 2 and 3, the corona discharger of the present invention consists of a ground electrode tube 2, a single-opening insulating tube 3 to be inserted into the ground electrode tube 2, a high-voltage electrode tube 4 to be inserted into the insulating tube 3, and two insulating caps 5 each equipped with an air hole 50.

The ground electrode tube 2 is an open-end tube conductor, preferably made of a seamless stainless steel tube, with one end equipped with a protruding connector 21.

The insulating tube 3 is a single-opening tube insulator, preferably made of an industrial ceramic or glass. In assembling the device, the projecting pieces 51 at the inner side of the end of the cap 5 separates the outer wall 31 of the insulating tube 3 and the inner wall 22 of the ground electrode tube 2, thereby forming a gap 30 (see FIG. 3), which functions as the space in which the corona is discharged.

The high-voltage electrode tube 4, which constitutes the innermost layer, is an open-end tube conductor, preferably made of copper, with one end equipped with a protruding connector 41. When the device is assembled, the connector 41 protrudes from the insulating cap 5 at the end opposite from the ground electrode tube connector 21, as shown in FIG. 3. In order to minimize the corrosion of surface 42 of the high-voltage electrode tube 4 during corona discharges, the surface 42 is coated with a layer of heat-resistant shrink film 4 3 before the high-voltage electrode tube 4 is inserted into the single-opening insulating tube 3, so that the high-voltage electrode tube 4 can adhere tightly to the inner wall. Furthermore, in order to realize a higher conductivity for the high-voltage electrode tube 4, its surface is plated with 24K gold or with another high-conductivity metal before the heat-resistant shrink film 43 is applied. The high-voltage electrode robe 4 is held inside the single-opening insulating tube 3 by means of an insulating plug 44, while the connector 41 of the high-voltage electrode tube 4 protrudes from the opening 441 of the insulating plug 44.

The design principle of the high-voltage electrode tube 4 is explained below. The resistance of a conductor is $R=\rho\times L/A$ (i.e., the resistance R is proportional to the length (L) of the conductor and inversely proportional to the cross-sectional area of the conductor, and ρ is the conductivity coefficient of the conductor). Specifically, the high-voltage electrode tube 4 according to the present invention has a smaller cross-sectional area (A) than a conventional solid high-voltage rod of the same length (L), diameter and material. Moreover, gold has the highest conductivity coefficient ρ among conductors, thereby imparting to the device of the present invention a relatively high resistance. Furthermore, the high-voltage electrode tube 4 according to the present invention has a larger surface area than a conventional solid high-voltage rod of the same length (L) and cross-sectional area (A), thereby increasing the total corona-discharge area. In addition, the amount of heat generated when the high-voltage electrode tube 4 is operating is $W=VIt$ (i.e., the amount of heat generated is the product of the potential (V) between the high-voltage electrode tube 4 and the ground electrode tube 2, current (D and operating time (t)). Specifically, when the potential (V) and time (t) are the same, the high-voltage electrode tube 4 of the present invention exhibits a greater resistance than conventional solid high-voltage electrode rods. This allows the use of less current which, in turn, reduces appreciably the quantity of generated heat (i.e., lower temperature during operation). According to experiments conducted by the inventor with a voltage (V) of 8000 volts, direct current (D of 0.04 amperes and an operating time (t) of 144 hours, the ozone (03) generated was 60 ppm, the residual nitrogen oxides ($NO_x$) were less than 0.5 ppm and the surface temperature of the ground electrode tube 2 was approximately 36° C.

The configurations of the two insulating caps 5 each equipped with an air hole are similar, the inner side of the end of the cap 5 possessing several dual-function projecting pieces 51. The upper top surface 512 is used to position the ground electrode tube 2, and the lower top surface 514 is used to position the single-opening insulating tube 3. Each of the caps 5 is equipped with a through hole 501 or 503 to accommodate the ground electrode tube connector 11 and the high-voltage electrode tube 41. In addition, the outer side of the end of cap 5 is equipped with a positioning device 53 for installing the assembled corona discharger in a frame (i.e., not shown in the figures). The ground electrode tube 2, the single-opening insulating tube 3 and the high-voltage electrode tube 2 are connected together as one unit when the two ends of the ground electrode tube 2 are enclosed by the two caps 5. The several dual-function projecting pieces 51 cause the formation of a gap with an appropriate spacing between the ground electrode tube 2 and the single-opening insulating tube 3 and between the inner end surface of caps 5 and ground electrode tube 2 or single-opening insulating tube 3, as shown in FIG. 3, with the gap functioning as the space in which the corona discharge occurs and in which the air flowing through is subjected to ionization.

As described above, the conductivity effect and the electrical corrosion resistance of the high-voltage electrode robe of the present invention are superior to those of the conventional high-voltage electrodes.

What is claimed is:

1. An apparatus to generate corona discharges comprising:

(a) a ground electrode tube, a first end of which includes a protruding connector, (b) a single-opening insulating tube, said single-opening insulating tube is inserted into said ground electrode tube such that a gap is formed between an outer wall of said single-opening insulating tube and an inner wall of said ground electrode tube, (c) a high-voltage electrode tube which is inserted into said single-opening insulating tube, said high-voltage electrode tube includes a connector at a first end and is secured in an interior of said single-opening insulating tube by means of an insulating plug such that said connector of said high-voltage electrode tube protrudes from said single-opening insulating tube, and (d) two insulating caps; wherein said insulating caps encloses both ends of said ground electrode tube such that said ground electrode tube, said single-opening insulating tube, and said high-voltage electrode tube form a single unit, an outer surface of each of said insulating caps includes an air hole to allow the flow of air therethrough, said outer surfaces of said insulating caps also each include a hole that receives respectively said connector of said ground electrode tube and said connector of said high-voltage electrode tube, an inner surface of each of said insulating caps includes a plurality of dual-function projecting pieces so as to form an air space between said ground electrode tube and said single-opening insulating tube, and to form air spaces between said inner surfaces of said insulating caps and said ground electrode tube and said single-opening insulating tube respectively.

2. The apparatus of claim 1 wherein:

said high-voltage electrode tube is plated with a layer of high conductivity metal; to impart a higher conductivity.

3. The apparatus of claim 2 wherein:

said high conductivity metal is 24K gold.

4. The apparatus of claim 1 wherein:

said high-voltage electrode tube is covered with a heat-resistant shrink film so that said high-voltage electrode tube, when inserted into said single-opening insulating tube, adheres tightly to an interior wall of said single-opening insulating tube to protect said high-voltage electrode tube form being damaged by said corona discharges.

5. The apparatus of claim 1 wherein:

said ground electrode tube is a seamless stainless steel tube.

6. The apparatus of claim 1 wherein:

said insulating tube is made of industrial ceramic.

7. The apparatus of claim 1 wherein:

said insulating tube is made of glass.

8. The apparatus of claim 1 wherein:

said high-voltage electrode tube is a seamless copper tube.

* * * * *